United States Patent [19]

Coüwenbergs

[11] Patent Number: 4,596,103

[45] Date of Patent: Jun. 24, 1986

[54] STONE SET FOR VERTICAL WALL ASSEMBLIES

[76] Inventor: Paul Coüwenbergs, Scheibenbergstrasse 17, D-7500 Karlsruhe 21, Fed. Rep. of Germany

[21] Appl. No.: 659,407

[22] Filed: Oct. 10, 1984

[30] Foreign Application Priority Data

Oct. 20, 1983 [EP] European Pat. Off. ..... 83110449.2

[51] Int. Cl.[4] ..... E04B 5/04

[52] U.S. Cl. ..... 52/604; 52/609

[58] Field of Search ..... 52/604, 608, 609, 610; 404/41, 37, 38, 39, 40; 446/108, 125, 127, 124

[56] References Cited

U.S. PATENT DOCUMENTS

| | | | |
|---|---|---|---|
| 1,687,342 | 10/1928 | MacVeigh et al. | 52/609 X |
| 4,426,176 | 1/1984 | Terada | 52/610 X |
| 4,524,551 | 6/1985 | Scheiwiller | 52/608 X |

FOREIGN PATENT DOCUMENTS 3138155 4/1983 Fed. Rep. of Germany .

*Primary Examiner*—Carl D. Friedman

*Assistant Examiner*—Creighton Smith

*Attorney, Agent, or Firm*—McCormick, Paulding & Huber

[57] ABSTRACT

A stone set is described in which a fundamentally known base stone, especially a base stone of concrete or the like, with a principally L-shaped cross-sectional surface is used. The base stone (1) has on its first and second legs (2; 3) a first and second seat (4; 7), respectively. The seats (4; 7) are formed complementary to one another as a recess or projection. In an assembly of exclusively base stones the result is a wall inclined relative to the vertical. The wall set in accordance with the invention, in contrast to this, makes possible the construction of a vertical wall through the use of a supplemental stone (10) with a likewise L-shaped cross-sectional surface. On its first leg (12) a first and second seat (15; 14) are provided on its upper and lower sides, to engage the first and second seat (4; 7) of base stones (1) located above and below it. The stones arranged in an assembly are similarly oriented and aligned. The supplemental stone engages with the free end of its second (vertical) leg (13) the base stone (1) located below it so that the wall assembly receives greater stability.

20 Claims, 10 Drawing Figures

STONE SET FOR VERTICAL WALL ASSEMBLIES

The invention relates to a stone set for constructing an essentially vertical wall assembly with a base stone having a principally L-shaped cross-sectional surface, the base stone being especially an artifical stone of concrete or the like with a first (horizontal) and a second (vertical) leg with at least two seats, of which the first seat is located on the outer side of the first (horizontal) leg and the second seat is located on the free end of the second (vertical) leg, with the seat including a recess or a projection which in the assembly of the base stones engages with a complementary projection or a complementary recess of the seat of an adjoining stone of the assembly, and with the seats on the base stone being so arranged relative to one another that in the case where similarly oriented base stones are supported directly on one another a wall assembly inclined to the vertical is produced.

A base stone of the general type described is known for example from DE-OS No. 31 38 155. In that case a stone has complementarily formed recesses and projections which in an assembly of stones supported on one another serve as opposite sided seats, since the recesses and projections of one stone come into engagement with the projections and recesses of adjacent stones. The stones are usable to advantage in different ways and in assemblies which consist exclusively of these stones can for example be used as greens bearing embankment stabilizers.

A disadvantage is, however, that in the assembly of such stones no stable vertical wall can be obtained from simply laying layers of stone on one another, to create a free-standing wall, the assembly being basically advantageous to provide a wall inclined to the vertical for stabilizing an embankment or slope.

Further, no closed flat side face is obtained with a wall made of the known stones, but instead because of the horizontal legs of the stones the result is that for each stone layer of the wall a bar-like forwardly projecting interruption is formed which may be planted with greens when the known stones are used as an embankment stabilizer.

The invention therefore has as its basic object the creation of the possibility, through the use of base stones such as are already fundamentally known, of making a stable vertical wall assembly with a flat closed side face.

This basic object is solved by a stone set in which a supplemental stone with principally an L-shaped cross-sectional surface has a first (horizontal) and a second (vertical) leg, which are arranged perpendicular to one another, of which the first (horizontal) leg has a first seat on its outer side for supportingly engaging a first base stone as well as a second seat on its inner side for supportingly engaging another base stone, and of which the second (vertical) leg has a third seat on its free end for engagement with a seat on the inner side of the first (horizontal) leg of a base stone arranged therebelow, the first and second seats on the supplemental stone being so arranged that in an assembly of stones base stones located above and below the supplemental stones are similarly oriented and aligned with one another.

The supplemental stones are used in the assembly together with base stones, as is at least basically known, and are arranged as intermediate stones between upper and lower layers of base stones. Thus, the base stones by means of their first and second seats, which are also provided in an assembly of exclusively base stones, in accordance with the invention come into engagement with the first or second seats of the supplemental stones. These seats are so arranged on the supplemental stones that in an assembly of base stones and supplemental stones arranged alternately over one another—in contrast to an assembly exclusively of base stones—no displacement of the base stones from the vertical appears, so that a much more vertical wall assembly is obtained. Further, the supplemental stones have a second leg which in the wall assembly comes to be positioned vertically and which rests on the first—horizontal—leg of the underlying base stone, so that the wall assembly consists simply of stone rows supported upon one another and has sufficient stability for use as a free-standing wall. Further, a closed side surface is obtained since the vertically arranged second legs of the supplemental stone covers the hollow space formed between the two legs of the base stones. Each stone can moreover because of its form of construction be used individually for many applications.

A preferred embodiment provides that the first seat of the supplemental stone is formed as a projection and the second seat of the supplemental stone as a recess. Alternatively, other embodiments can provide that the first seat of the supplemental stone is formed as a recess and the second seat of the supplemental stone as a projection. Corresponding embodiments are then required for the mating seats of the base stones.

To create a closed flat side surface for a wall assembly the invention provides that the outer side of the second (vertical) leg of the supplementary stone is formed as a flat surface, which is aligned in a plane with a flat forward face bounding the free end of the first (horizontal) leg of the base stone located both above as well as below the supplemental stone in the assembly.

In other preferred embodiments the rearward side of the wall assembly is of a flat form, as in accordance with the invention the free ends of the first (horizontal) leg of the supplemental stone is bounded by a flat surface which is aligned with a surface on the outer side of the second leg of the adjoining base stone. For a closed flat surface on the entire rear wall the flat surface on the outer side of the second (vertical) leg of the base stone extends over the whole side of the second (vertical) leg. The embodiments with closed flat side faces are generally desired for optical reasons, in order for example for the wall to be best suited in a certain spot to the overall effect. Further a closed flat wall surface is required for boundary walls and walls for confinement, especially prison walls, in order to hinder climbing of the wall.

Usually the supplemental stone has the same length as the base stone. However, embodiments are also provided in which the supplemental stone has a several times larger length than the base stone. Such stones can be used for increasing the stability of the wall, for example by covering holes between base stones. With them it is possible to provide window-like breakthroughs and passages in the wall. Further, such long supplemental stones can also be used to cover the upper final row of stones. This is especially advantageous if the remaining supplemental stones and base stones of the wall assembly are arranged with holes. Special supplementary stones are used as cover stones and are provided with suitable cross-sectional surfaces for this function. For example the outer sides of both legs are made flat and/or of arcuate shape.

In a special embodiment the supplemental stone has a shorter length than the base stone and this stone serves as a compensating stone, for example as the end stone of a row in order to achieve an even ending of rows of superimposed stones which are displaced relative to one another along their lengths. Such end stones preferably have a length of one-quarter, one-half or three-quarters that of a full stone.

As a further special supplementary stone a foundation stone is provided which on its upper support side has a seat engageable with the first seat of the base stones of the lowermost row of stones of the wall assembly.

As such a foundation stone a supplemental stone can basically be used which is normally used as an intermediate stone between upper and lower adjoining base stones. In this case, it is of advantage to sink the second vertical leg of the supplemental stone into the ground for anchoring so that a level foundation surface for the wall is obtained. On the other hand, to achieve a level foundation surface the second leg of the supplemental stone can be cut off. Basically the foundation stone and cover stone are made by changing the supplemental stone provided normally as an intermediate stone between base stones.

Further advantages and features of the invention will be apparent from the claims and from the following description, in which exemplary embodiments of the invention are explained in connection with the drawings. The drawings are:

Figures 1A, 1B, 2:
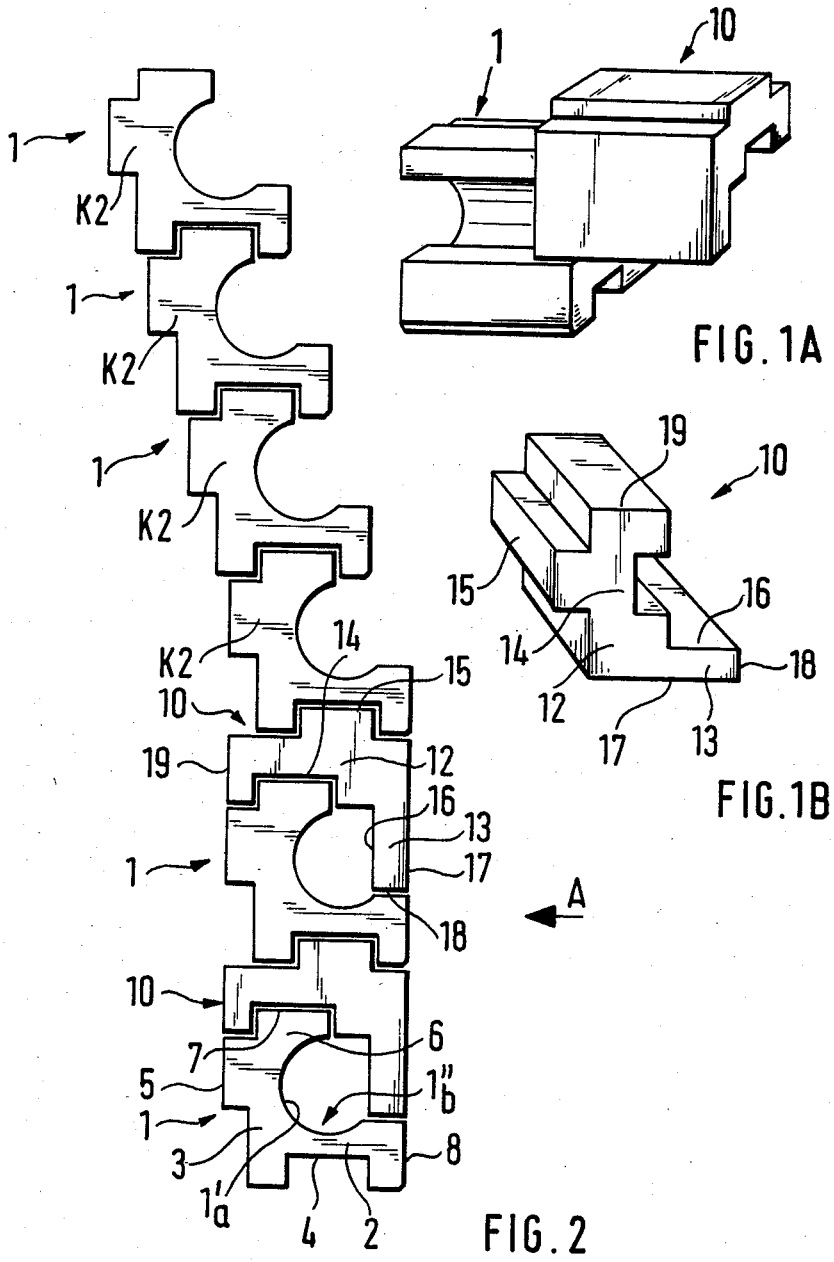
FIGS. 1A and 1B are perspective views, on one hand of a supplemental stone according to the invention and a base stone in displaced position relative to one another and supported on one another and on the other hand of a supplemental stone by itself.
FIG. 2 is a sectional view of a wall assembly made of supplemental stones embodying the invention and base stones.

The base stone 1 in cross section, as best seen in FIG. 2, has an essentially L-shaped cross-sectional surface insofar as the main lines of extension of a first and a second leg 2 and 3, as given by the flow of the outer sides of the legs, are arranged at right angles to one another. The other sides of the legs 2, 3 which are turned toward one another have a common arcuate surface 1 which forms a trough 1''. On the other hand the outer sides of the legs are made exclusively of flat surface sections arranged at right angles to one another. The side of the first leg 2 which is turned away from the second leg 3—that is, the outer side—has a recess 4, while the side of the second leg 3 turned away from the first leg 2—that is, its outer side—has an associated projection 5. The free end of the second leg 3 is formed by a projection 7, which adjoins at right angles the projection 5 located on the outer side of this leg. The projections and the recesses form, as best understood from FIG. 1A, similar ridges and grooves running along the length of the base stone 1. Between the legs a trough-shaped space extends along the length of the stone.

The supplementary stone 10 likewise has a generally L-shaped cross-sectional surface and consists of a first and a second leg 12 and 13 connected to one another at right angles. On the side of the first leg 12 turned toward the second leg 13—that is, the inner side—is a recess 14, and on the side of the leg 12 turned away from the second leg 13—that is, the outer side—is a projection 15 displaced relative to the recess. The inner and outer sides of the second leg 13 as well as the boundary surface of its free end are formed as flat surfaces 16, 17 and 18. The recess 14 and the projection 15 of the supplementary stone 10 basically form, as with the base stone 1, a groove and ridge running along the length of the supplementary stone, as seen in FIGS. 1A and 1B. The stone of FIG. 1B can be used separately as an enclosing stone, with several such stones being arranged in a row.

The recess 14 and the projection 15 of the first leg 12 of the supplementary stone are complementary to the projection 7 at the free end 6 of the second leg 3 of the base stone 1 and to the recess 4 of the outer side of the first leg 2 of the base stone 1. These complementary parts are received by one another if the base stone and the supplementary stone are arranged in alternating succession above one another in a vertical wall assembly as basically represented in FIG. 2.

Thus in such an assembly a supplemental stone 10 engages, as an intermediate stone between upper and lower layers of base stones of the wall, with the inner side of its first leg 12 —that is, its horizontal leg—the free end 6 of the second leg 3—that is, the vertical leg—of a base stone 1 located beneath it. At the same time, the second leg 13 of the supplemental stone 10 reaches to and rests on the inner side of the first leg 2 of the base stone 1 supported below it. On the outer side of the first leg 12 of the supplemental stone 10—that is, the horizontal leg—is supported a base stone 1 arranged above it by means of the outer side of its first leg 2—that is, its horizontal leg.

A wall built in such a way forms a positively contacting rigid assembly of high stability and is suited for a free-standing wall. The stones in the assembly are secured against displacement as well as against movement from their desired alignment by the effects of pushing forces.

In using supplemental stones 10 in combination with base stones 1, by the orientation of the supplemental stones and by the arrangement of the stones in the assembly the side of the wall can for example be made as a complete vertical wall with holes for greens. The flat surface 17, which forms the outwardly-facing side of the second leg 13 of the supplemental stone 10, is in alignment with the boundary surface at the free end of the first leg 2 of the upper and lower base elements of the wall assembly of FIG. 2. Above such a vertical wall an inclined slope or embankment reinforcement can continue on as likewise illustrated in FIG. 2.

Figure 3:
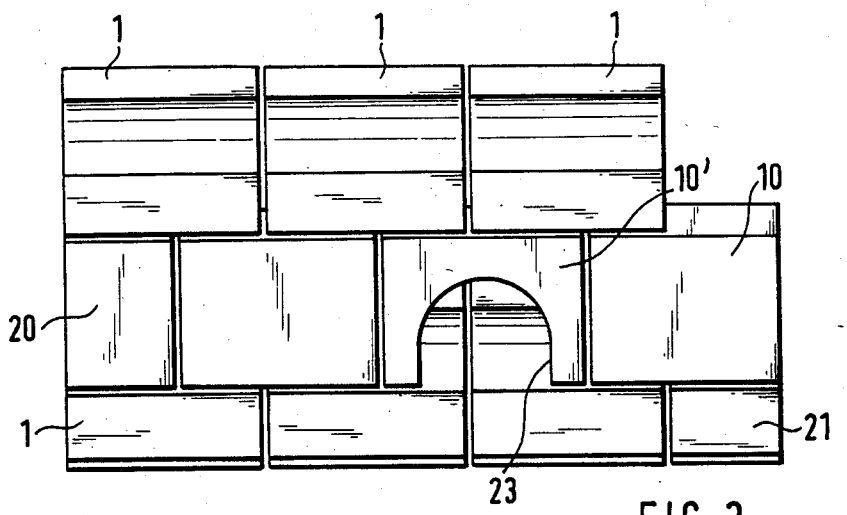
FIG. 3 is a side view of a form of wall assembly of FIG. 2 taken looking in the direction of the arrow A of FIG. 2.

In the illustrated wall assembly of FIG. 3 a supplemental stone 10' includes a gate-like breakthrough 23 in its second vertical leg 13. This therefore provides an access to the hollow inner space in the form of a horizontal channel existing between the stones of a row of base stones and a row of supplemental stones supported on the row of base stones. This free access is an advantage if conductors are laid inside the channel. If only supplemental stones with gate-shaped breakthroughs 23 are used, the trough 1'' (FIG. 2) can be partially filled with earth (which preferably is done in layers as the wall is constructed). A planting planted in this earth can then grow out through the breakthrough 23 and from there receive light and water.

In the wall of FIG. 3 at the end of a row of supplemental stones a compensating stone 20 is arranged, which has an identical shape to the other supplemental stones 10 except for having a shorter length. A compensating base stone 21 is also provided which has a shorter length than the other base stones 1 making up the wall.

On the rear side of the wall shown in FIG. 3 are groovelike recesses, such as in the sectional view of FIG. 2, extending in the longitudinal direction of the wall, and one for each row of the base elements, which grooves are formed between the projection 5 of each base stone 1 of a row and the boundary surface 19 of the free end of the first—horizontal—leg 12 of each supplemental stone 10 of the row located under the row of base stones. The rear side of the wall has flat surfaced strips between these groove-like recesses formed on the free ends of the first legs 12 of the supplemental stones of a row and of the flat surfaces aligned with these on the projections 5 on the outer side of the second—vertical—legs 3 of the base stones of the underlying row. This "rear side" can, if a structured surface is desired, also serve as the forward side. Understandably, the entire rear side like the forward side (FIG. 3), of this wall can be formed as an entirely complete flat surface by using corresponding complementary shapes for the base stones 1 and/or the supplemental stones 10.

Figure 4:
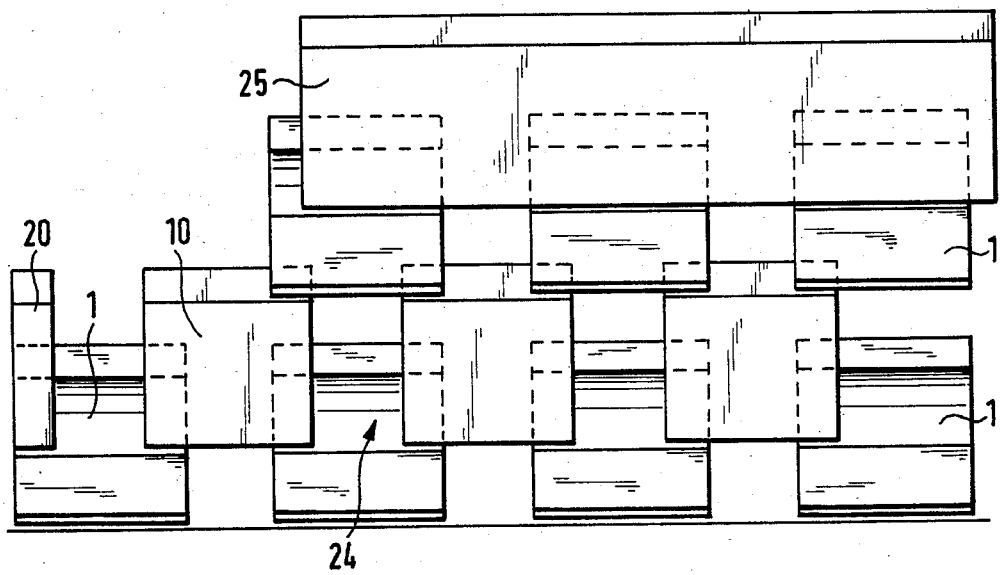
FIG. 4 is a side view of a further form of the wall assembly of FIG. 2 taken in the direction of the arrow A of FIG. 2.

In the case of the wall assembly illustrated in FIG. 4 the base stones 1 and supplemental stones 10 are arranged in rows with similar holes between the stones 1 and 10. That is, the stones 1, 10 supported on one another are supported over the holes so that each stone 1 or 10 engages with both of its ends the ends of two stones located below it, so that the stone bridges the two stones 10 or 1 forming the opening. The result is a wall assembly with window-like openings 24. The trough-like space or channel 1'' arranged between the legs 2, 3 of a base stone is outwardly free so that this interior space of the base stones can be filled with earth and plants. Obviously in this case supplemental stones 10' with gate-like breakthroughs 23 (see FIG. 3) could also be used, to further improve the relationship of open, greened surface to the stone front of the wall.

On the uppermost row of base stones of the wall in FIG. 4 is supported a cover plate 25 having a cross-sectional shape similar to that of the remaining supplemental stones 10 used as intermediate parts in the wall. This cover plate 25 is essentially a supplemental stone with a longitudinal length corresponding to several times the length of a customary supplemental stone 10 or basic stone 1. The cover plate 25 is optically advantageous since it bridges the groove-like upper edge of the upper row of base stones. At the same time the cover plate 25 serves as a stabilizing device. Obviously, corresponding supplemental stones with large longitudinal length can also be used in lower rows of supplemental stones of the wall assembly, in order to increase the stability of the wall or to bridge large openings in the stones of the immediately lower row, for example to form passageways or the like.

Figure 5:
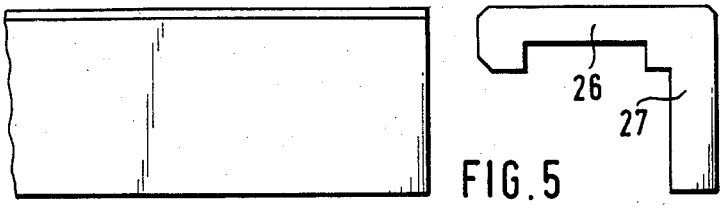
FIG. 5 is a sectional view (on the left) and a side view (on the right) of an embodiment of a cover plate.
Figure 6:
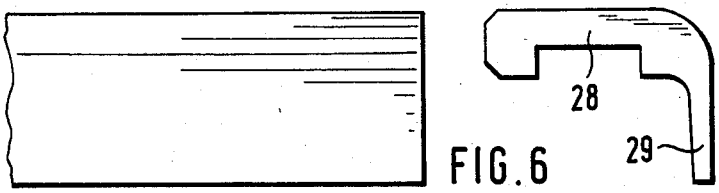
FIG. 6 is a sectional view (on the left) and a side view (on the right) of a further embodiment of a cover plate.
Figure 7:
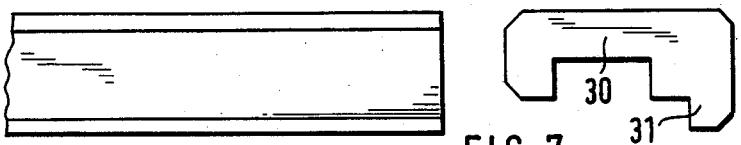
FIG. 7 is a sectional view (on the left) and a side view (on the right) of a still further embodiment of a cover plate.

Three further forms of cover plates are illustrated in FIGS. 5, 6 and 7. These have, on the sides of the legs facing one another a cross-sectional shape similar to that of the supplemental stones of FIGS. 1 to 4. In the embodiment of FIG. 5 flat outer sides are provided on the legs 26, 27 and the projection 15 of a supplemental stone such as that of FIG. 2 is omitted. In the embodiment of FIG. 6 the outer sides of the legs 28, 29 form a common arcuate surface. In the embodiment of FIG. 7 the vertical leg is shortened in comparison to the embodiment of FIG. 5. The cover plate consists therefore essentially of only a horizontal leg 30 and a vertical stub 31 so that with its use instead of the above-mentioend embodiment the trough-shaped inner space of the base stones of the upper row remain open from the front.

The supplemental stones 10 with the cross-sectional shape as shown in FIGS. 1 to 4, and especially the building stone 25 of FIG. 4 provided as a cover plate can also be used to advantage as the foundation stone of a wall assembly. In this case the second leg 15 is set vertically into the floor and forms an anchor. The side of the first leg 12 which is turned away from this second leg 30, and therefore upper side, forms with its projection 15 a support for the lowermost row of base stones of the wall assembly. In this case a sort of concrete footing, which is usually necessary, can be omitted and the lengthened supplemental stone 25 can be simply laid into the earth.

Other embodiments of the foundaton stone permit one to manufacture them from supplemental stones provided almost as intermediate stones. If the foundation stones are to be laid on an even, for example concrete, support surface, in their manufacture the second (vertical) legs of the supplemental stones are cut off so that the original inner side of the remaining first legs have a flat underside with recess 14. This flat underside of the stone serves then as the bearing surface for the foundation stones on the underlying support surface. In this case there is therefore no anchoring of the foundation stones into the underlying support.

Figure 8:
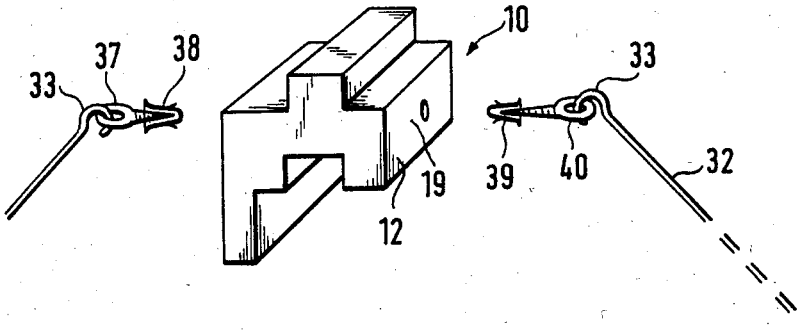
FIGS. 8 and 9 are perspective views of constructions of the anchoring arrangement for a wall assembly made of supplemental stones according to the invention and base stones.

For anchoring the wall, base stones 1 and supplemental stones 10 of a wall assembly, as shown in FIG. 8, are provided in their outwardly directed sides with sockets 41, 38, 39 and screw eyes 42, 37, 40 or the like which serve as fastening devices for receiving an anchor cable which with one of the hooks 33 provided on one of its ends engages the eye 42, 37, 40 on one base stone 1 or supplemental stone 10 of the wall and with its other end is otherwise held fast, for example in a rigid hooked intermediate piece 45, as shown in FIG. 8.

Figure 9:
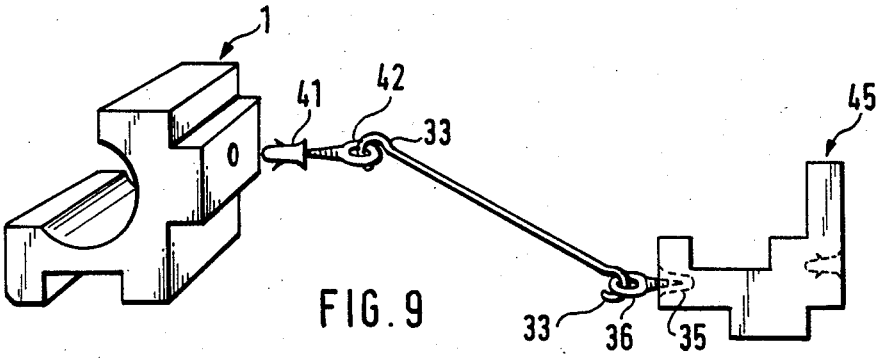

Further, it is also possible to have an opposite sided anchoring of two parallel wall faces as shown in FIG. 9 which is analogous to FIG. 8.

The features of the invention disclosed by the present description, drawings, and claims, can individually as well as in proper combinations can be essential to the development of the invention in its different embodiments, so that the stone set can be used in an arrangement turned 180 degrees from the representations made by the drawings (especially FIG. 2). Moreover, corner and angle stones with essentially similar cross-sectional shapes, such as those described, are possible.

REFERENCE NUMBER LIST

1—base stone
2—first leg (horizontal) of the base stone

3—the second leg (vertical) of the base stone
4—recess of the base stone
5—projection of the base stone
6—free end of the second leg of the base stone
8—boundary surface of the free end of the first leg of the base stone
10—supplemental stone
12—first leg (horizontal)
13—second leg (vertical)
14—recess
15—projection
16—inner surface of the second leg (vertical)
17—outer surface of the second leg (vertical)
18—boundary surface of the free end of the second leg
20—compensating supplementary stone
21—compensating base stone
23—gate-like breakthrough in supplementary stone 10'
26—leg of the cover plate (FIG. 5)
27—leg of the cover plate (FIG. 5)
28—leg of the cover plate (FIG. 6)
29—leg of the cover plate (FIG. 6)
30—leg of the cover plate (FIG. 7)
31—leg of the cover plate (FIG. 7)
32—anchoring stay
33—hook
34—hook
35—socket
36—screw eye
37—screw eye
38—socket
40—screw eye
41—socket
42—screw eye
45—supplemental stone as anchor.

I claim:

1. A stone set for building a wall assembly which set includes a base stone with a principally L-shaped cross-section, especially of artifical stone of concrete or the like, with a first horizontal leg and a second vertical leg, and first, second and third seats, all of which seats run horizontally the full length of said base stone, each of said first and second legs having an inner side, an outer side and a free end, said first seat being arranged on the outer side of the first leg, said second seat being located on the free end of the second leg, and said third seat being located on the inner side of the first leg, each of said first and second seats being in the form of either a recess or a projection which in an assembly of base stones mates with a complementary second or first seat of an adjoining stone of the assembly, and said first and second seats of the base stone being so arranged relative to one another that if base stones are supported directly on one another in identical orientation with their first legs horizontal and with the first seat of each stone mated with the second seat of a vertically adjacent stone the result is a wall assembly inclined to the vertical, and a supplemental stone with a principally L-shaped cross-section different from that of said base stone having a first horizontal leg and a second vertical leg arranged perpendicularly to one another, each of said first and second legs of said supplemental stone having an inner side, an outer side and a free end, said first leg of said supplemental stone having a first seat on its outer side for engagement with said first seat of a base stone as well as a second seat on its inner side for engagement with the said second seat of another base stone, said first and second seats of said supplemental stone running horizontally the full length of said supplemental stone and said second leg of the supplemental stone having a third seat on its free end for engagement with said third seat on the inner side of the first leg of an underlying base stone, said first and second seat of said supplemental stone being so arranged that when supplemental stones are assembled with base stones so that two base stones immediately overlie and underlie a supplemental stone such base stones as immediately overlie and underlie a supplemental stone are identically oriented and vertically aligned with one another.

2. A stone set according to claim 1 further characterized in that the first seat of the supplemental stone is formed as a projection and the second seat of the supplemental stone is formed as a recess.

3. A stone set according to claim 1 further characterized in that the outer end of the first leg of the base stone is formed as flat vertical surface, and the outer side of the second leg of the supplemental stone is formed as a flat vertical surface which when a supplemental stone is assembled with two base stones immediately overlying and underlying it is aligned with said flat vertical surfaces of said base stone.

4. A stone set according to claim 1 further characterized in that the free end of the first leg of the supplemental stone is bounded by a flat surface which is aligned with a surface on the outer side of the second leg of an adjoining base stone.

5. A stone set according to claim 4 further characterized in that the flat surface on the outer side of the second leg of the base stone extends over the entire side of the second leg.

6. A stone set according to claim 1 further characterized in that the second leg of the supplemental stone has a breakthrough in said second leg.

7. A stone set according to claim 1 further characterized in that the supplemental stone has the same length as the base stone.

8. A stone set according to claim 1, characterized in that the supplemental stone has a length several times greater than the length of the base stone.

9. A stone set according to claim 1 further characterized in that the supplemental stone has a shorter length than the base stone.

10. A stone set according to claim 1 further characterized in that the supplemental stone on the outer side of its second leg has a fastening device for receiving a fastening member on the end of an anchoring device.

11. A stone set according to claim 1 further characterized in that the supplemental stone has a fastening device on the free end of its first leg for receiving a fastening member at the end of an anchoring device.

12. A stone set according to claim 1 further characterized in that a cover stone is provided which on its support side has a support engageable with second seat of a base stone located in a uppermost row of the wall assembly.

13. A stone set according to claim 12 further characterized in that the cover stone has a principally L-shaped cross-section surface with a first horizontal leg and a second vertical leg, both of said first and second legs of said cover stone having inner and outer sides, said first and second legs of said cover stone being arranged perpendicular to one another and said first leg having a seat on its inner side.

14. A stone set according to claim 13 further characterized in that the second leg of said cover stone leg is bounded by a flat surface which is supported on a seat on the inner side of the second leg of the base stone.

15. A stone set according to one of claims 13 further characterized in that the outer side of the first leg of the cover stone and the outer side of the second leg of the cover stone are formed as flat surfaces.

16. A stone set according to claim 13 further characterized in that the outer side of the first leg of the cover stone and the outer side of the second leg of the cover stone are arranged in a common arcuate surface.

17. A stone set according to claim 1 further characterized by a foundation stone having an upper support side with a seat engageable with the first seat of a base stone located in the row of stones of a wall assembly supported on a row of foundation stones.

18. A stone set according to claim 1 further characterized in that the inner side of the legs of the base stone are joined to one another by an arcuate shape.

19. A stone set according to claim 1 further characterized in that said second seat on said second leg of said base stone is a projection and said second leg of said base stone having a step formed between said projection and the outer side of said second leg of said base stone.

20. A stone set according to claim 1 further characterized in that said second seat on the secodd leg of the base stone is formed to overhang the first leg.

* * * * *